US006736950B1

(12) United States Patent
Klein et al.

(10) Patent No.: US 6,736,950 B1
(45) Date of Patent: May 18, 2004

(54) METHOD FOR ELECTROPHORETICALLY IMMERSION-ENAMELING SUBSTRATES THAT HAVE EDGES

(75) Inventors: Klausjörg Klein, Wuppertal (DE); Walter Kühhiri, Remscheid (DE); Siegfried Kuphal, Helmstedt (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 10/018,391

(22) PCT Filed: Apr. 29, 2000

(86) PCT No.: PCT/EP00/03898

§ 371 (c)(1),
(2), (4) Date: Mar. 28, 2002

(87) PCT Pub. No.: WO00/68467

PCT Pub. Date: Nov. 16, 2000

(30) Foreign Application Priority Data

May 7, 1999 (DE) ..... 199 21 223

(51) Int. Cl.[7] ..... C25D 13/10

(52) U.S. Cl. ..... 204/489; 204/500; 204/506; 204/507; 204/509; 204/493; 428/416

(58) Field of Search ..... 204/489, 500, 204/506, 507, 509, 493; 428/416

(56) References Cited

U.S. PATENT DOCUMENTS

| | | | |
|---|---|---|---|
| 4,039,414 | A | 8/1977 | McGinniss |
| 4,040,925 | A | 8/1977 | McGinniss |
| 4,066,523 | A | 1/1978 | McGinniss |
| 4,070,258 | A | 1/1978 | McGinniss |
| 4,540,598 | A | 9/1985 | Berner et al. |
| 4,559,371 | A | 12/1985 | Huesler et al. |
| 5,091,439 | A | 2/1992 | Berner et al. |

*Primary Examiner*—Kishor Mayekar
(74) *Attorney, Agent, or Firm*—Steven C. Benjamin

(57) ABSTRACT

Method of electro-dipcoating while reducing edge migration on stoving by 1) electro-deposition of a coating layer from an electrically depositable coating composition containing a heat-curable binder system having a content of olefinically unsaturated double bonds that are radically polymerisable under UV irradiation, on an electrically conductive substrate having edges,
2) UV irradiation of at least part of the electrically deposited coating layer, avoiding complete curing,
3) complete curing of the electrically deposited coating layer by stoving.

25 Claims, No Drawings

METHOD FOR ELECTROPHORETICALLY IMMERSION-ENAMELING SUBSTRATES THAT HAVE EDGES

This application is 35 U.S.C. 371 National Stage filing of PCT/EP00/03898 filing Apr. 29, 2000.

BACKGROUND OF THE INVENTION

The invention relates to a method of lacquering electrically conductive substrates with electrically depositable aqueous electro-dipcoating lacquers (EDL). The invention relates also to a method of preventing edge migration on the stoving of electrically deposited EDL coating layers.

Electro-dipcoating lacquers are used especially to produce anti-corrosive primer coats on metallic substrates. However, they may, for example, also be deposited and stoved on any desired electrically conductive substrates as a single-layer finishing lacquer, a clear lacquer, or as a lacquer layer that is arranged within a multilayer lacquer coating. An EDL coating layer arranged within a multilayer lacquer coating may be, for example, a lacquer layer having a decorative effect, which serves as a finishing lacquer or may be covered with a clear lacquer layer.

A problem in the case of lacquering with electro-dipcoating lacquers is edge migration on stoving of an EDL coating layer deposited beforehand on an electrically conductive substrate. The EDL coating layer pulls away from the edge, with a reduction in the layer thickness at or in the immediate vicinity of the edge. In the extreme case, the edge is insufficiently covered after stoving. While this is noticeable, for example, in the case of decorative EDL coatings as a difference in colour because the substrate shows through in the region of the edge, it results in the case of anti-corrosive EDL primer coats in an impairment or in the loss of the anti-corrosive action at or in the region of the edge. Apart from the technical disadvantages of edge corrosion, corrosion at edges that are accessible to an observer is troublesome in particular from a visual point of view, for example in the form of visible rust spots and runs that form during use of the lacquered substrates. EDL coating compositions that are curable by irradiation with ultraviolet light, and the curing by UV irradiation of EDL coating layers deposited electrically from such EDL coating compositions, are known inter alia from U.S. Pat. Nos. 4,040,925 and 4,039,414.

SUMMARY OF THE INVENTION

The object of the invention is to provide a method of electro-dipcoating with which EDL coatings with good edge coverage can be obtained on electrically conductive substrates having edges, that is to say the deposited EDL coating layer is to exhibit no or only slight edge migration behaviour on stoving. In particular, edge migration at edges that are accessible to an observer is to be avoided, in order to avoid the undesirable occurrence of visually disturbing corrosion phenomena at such edges during subsequent use of the lacquered substrates.

It has been found that that object can be achieved if a heat-curable EDL coating composition containing a binder system having a content of radically polymerisable olefinically unsaturated double bonds is used for the electro-dipcoating of an electrically conductive substrate having edges, and if, before stoving of the coating layer deposited electrically from the EDL coating composition, UV irradiation of the electrically deposited coating layer is carried out at least at edges of the substrate and the wholly or partially UV-irradiated EDL coating layer is then cured by stoving. The term "curing" used here and hereinbelow means curing in the sense of a chemical crosslinking of the EDL coating layer by formation of covalent bonds between the constituents of the heat-curable EDL binder system.

Only so-called dual-cure systems have hitherto been known from the literature. In such systems, curing takes place in the opposite manner. For example, U.S. Pat. No. 4,066,523 and U.S. Pat. No. 4,070,258 describe electro-dipcoating lacquers and combinations of polymers with tertiary amino groups, polymers with lateral mercapto groups, a bismaleimide crosslinking agent or an ethylenically unsaturated carbonyl crosslinking agent, which are cured after deposition first by means of heat and finally by UV irradiation.

Accordingly, the present invention provides a method of electro-dipcoating, consisting of the successive steps:

1) electro-deposition of a coating layer from an EDL coating composition containing a heat-curable binder system having a content of olefinically unsaturated double bonds that are radically polymerisable under UV irradiation, on an electrically conductive substrate having edges,
2) UV irradiation of the electrically deposited coating layer, at least in the region of the edges, and then
3) curing of the EDL coating layer by stoving.

A preferred embodiment of the invention comprises a method of electro-dipcoating consisting of the successive steps:

1) electro-deposition of a coating layer from an EDL coating composition containing a heat-curable binder system having a content of olefinically unsaturated double bonds that are radically polymerisable under UV irradiation, on an electrically conductive substrate having edges,
2) UV irradiation of the electrically deposited coating layer in the region of the edges, especially of the electrically deposited coating layer at the edges,
3) curing of the EDL coating layer by stoving.

The method according to the invention can advantageously be used for the electro-dipcoating of three-dimensional, electrically conductive, especially metallic, substrates having edges and having regions that are directly accessible and regions that are not accessible to an observer, especially having edges that are directly accessible and edges that are not accessible to an observer. "Directly accessible to an observer" means "accessible to the eye of an observer from the outside without particular technical or optical aids". Only regions or edges that are directly accessible to an observer are also directly accessible to UV irradiation. Examples of substrates having regions that are directly accessible and regions that are not accessible to an observer, especially having edges that are directly accessible and edges that are not accessible to an observer, are especially motor vehicle bodies with their hollow spaces, joins and other construction-related undercuts. Examples of edges of motor vehicle bodies that are directly accessible to an observer are externally visible cut edges of individual body components, the edges of holes, for example of clip holes or of openings provided for components that are to be inserted, such as windows, head lamps, door locks or door handles, and the edges, of roof rails.

DETAILED DESCRIPTION OF THE INVENTION

Accordingly, the invention relates in a particular embodiment to a method of electro-dipcoating consisting of the successive steps:

1) electro-deposition of a coating layer from an EDL coating composition containing a heat-curable binder system having a content of olefinically unsaturated double bonds that are radically polymerisable under UV irradiation, on a three-dimensional, electrically conductive substrate having edges and having regions that are accessible and regions that are not accessible to an observer, 2) UV irradiation of the electrically deposited coating layer in regions of the substrate surface that are directly accessible to an observer, 3) curing of the EDL coating layer by stoving.

The particular embodiment of the method according to the invention is preferably a method of electro-dipcoating consisting of the successive steps:

1) electro-deposition of a coating layer from an EDL coating composition containing a heat-curable binder system having a content of olefinically unsaturated double bonds that are radically polymerisable under UV irradiation, on a three-dimensional, electrically conductive substrate having edges that are directly accessible and edges that are not accessible to an observer, 2) UV irradiation of the electrically deposited coating layer in the region of edges of the substrate that are accessible to an observer, especially the EDL-coated edges that are directly accessible to an observer, 3) curing of the EDL coating layer by stoving.

The electro-dipcoating lacquers used in the method according to the invention are aqueous coating compositions having, for example, from 10 to 30 wt. % solids. They may be anodically or cathodically depositable electro-dipcoating lacquers. The solids in the electro-dipcoating lacquers used in the method according to the invention are formed by the resin solids of the EDL binder system, optionally present reactive diluents (compounds which are incorporated chemically into the lacquer film on UV irradiation and/or during the stoving process), pigments, fillers and further non-volatile additives conventionally employed in lacquers. Solids here and hereinbelow means theoretical solids; it does not take account of any losses, for example losses on evaporation and/or stoving during application, UV irradiation and curing of the EDL coating composition. The binder system of the EDL coating compositions used in the method according to the invention is composed of one or more EDL binders, crosslinking agents that may optionally be present, paste resins that may optionally be present and non-ionic additional resins that may optionally be present. For example, the EDL binder system is composed of solids proportions by weight, which add up to 100 wt. %, of from 50 to 100 wt. % EDL binder, from 0 to 50 wt. % crosslinking agent, from 0 to 30 wt. % non-ionic additional resins and from 0 to 20 wt. % paste resin. The crosslinking agents, non-ionic additional resins and/or paste resins may optionally be identical substances which simultaneously perform two or three functions in the EDL coating composition, for example serve both as non-ionic additional resin and as crosslinking agent or both as crosslinking agent and as paste resin. The sum of the by-weight solids of crosslinking agent, non-ionic additional resin and paste resin is not more than 50 wt. % of the resin solids in the EDL binder system. The binder systems contained in the EDL coating compositions used in the method according to the invention are binder systems that are conventionally employed for electro-dipcoating lacquers and that are curable by means of heat, especially by stoving, and contain olefinically unsaturated double bonds that are radically polymerisable under UV irradiation. The EDL binders and/or the crosslinking agents preferably contain olefinically unsaturated double bonds that are radically polymerisable under UV irradiation. The non-ionic additional resins and paste resins optionally contained in the EDL coating compositions may likewise contain olefinically unsaturated double bonds that are radically polymerisable under UV irradiation. Both the paste resins and the non-ionic additional resins may be reactive or non-reactive within the EDL binder system, that is to say they may be included or not included in the curing of step 3), regardless of whether they themselves contain olefinically unsaturated double bonds that are radically polymerisable under UV irradiation.

Examples of olefinically unsaturated double bonds that are radically polymerisable, for example, under UV irradiation and are contained in the EDL binder systems are vinylic C=C double bonds, (meth)allylic C=C double bonds and C=C double bonds bonded directly to carbonyl groups, especially (meth)acrylic double bonds. The content of olefinically unsaturated double bonds that are radically polymerisable under UV irradiation in the EDL binder systems is such that radical polymerisation of the olefinically unsaturated double bonds of the EDL binder systems can take place under UV irradiation. Depending on the nature (reactivity) and amount of the radically polymerisable olefinically unsaturated double bonds contained in the EDL binder systems, the EDL binder systems may be systems that are not curable, for example not completely curable, by radical polymerisation under UV irradiation, are so curable only with difficulty or are readily so curable. For example, the EDL binder systems contain radically polymerisable olefinically unsaturated double bonds according to a C=C equivalent weight of the resin solids of, for example, from 250 to 10,000, preferably from 500 to 10,000. In the case of EDL binder systems that are heat-curable by means of radical polymerisation, the C=C equivalent weight of the resin solids is in the lower range, for example from 250 to 2000. Preference is given, however, to EDL binder systems that are heat-curable by addition and/or condensation reactions, and the C=C equivalent weight of the resin solids in that case is higher, for example from 250 to 10,000, preferably from 500 to 3000. The C=C equivalent weight of the resin solids of the EDL binder system denotes the amount of resin solids, in grams, that contains one mole of olefinic double bonds. The radically polymerisable olefinically unsaturated double bonds may be part of the polymer backbone of polymeric constituents of the EDL binder system, especially of the EDL binders and/or of the crosslinking agents, and/or may be present as lateral and/or terminal functional groups of polymeric constituents of the EDL binder system, especially of the EDL binders and/or of the crosslinking agents. The double bonds can be introduced into the polymeric constituents of the EDL binder system, especially of the EDL binders and/or crosslinking agents, by various organo-chemical methods known to the person skilled in the art That may be effected, for example, by the use of corresponding low molecular weight olefinically unsaturated compounds, for example during and/or after conclusion of the actual EDL binder and/or crosslinking agent synthesis in the practically finished EDL binder and/or crosslinking agent by polymer-analogous reaction with corresponding low molecular weight olefinically unsaturated compounds. Examples which may be mentioned are the addition of epoxy-functional olefinically unsaturated compounds, such as, for example, glycidyl (meth)acrylate, to carboxyl- or hydrogen-active amino groups of the EDL binder and/or crosslinking agent; the addition of isocyanate-functional olefinically unsaturated compounds, such as, for example, isocyanatoalkyl (meth)acrylate, 3-isopropenyl alpha,alpha-dimethylbenzylisocyanate, or isocyanate-functional adducts of polyisocyanate and hydroxy-functional olefinically unsaturated compounds such as hydroxyalkyl (meth)acrylate or (meth)allyl alcohol, to hydroxyl- and/or hydrogen-active amino groups of the EDL binder and/or crosslinking agent; the addition of hydroxy-functional olefinically unsaturated compounds such as hydroxyalkyl (meth)acrylate or (meth)allyl alcohol to isocyanate groups of the EDL binder and/or crosslinking agent; and/or the addition of carboxy-functional olefinically unsaturated compounds such as (meth)acrylic acid to epoxy groups of the EDL binder and/or crosslinking agent.

The EDL coating compositions used in the method according to the invention may be anodically or cathodically depositable electro-dipcoating lacquers. The EDL binders therefore carry ionic substituents and/or substituents that can be converted into ionic groups. The crosslinking agents optionally contained in the EDL coating compositions may also have ionic groups and/or groups that can be converted into ionic groups. The ionic groups or groups that can be converted into ionic groups may be anionic groups or groups that can be converted into anionic groups, for example acid groups, such as —COOH, —$SO_3H$ and/or —$PO_3H_2$ and the corresponding anionic groups neutralised with bases. However, the ionic groups may also be cationic groups or groups that can be converted into cationic groups, for example basic groups, preferably nitrogen-containing basic groups; such groups may be present in quaternary form, or they are converted into cationic groups with a conventional neutralising agent, for example an organic monocarboxylic acid, such as, for example, formic acid or acetic acid. Examples are amino, ammonium, for example quaternary ammonium, phosphonium and/or sulfonium groups. Amino groups that are present may be primary, secondary and/or tertiary. The groups that can be converted into ionic groups may be present wholly or partially in neutralised form.

The EDL coating compositions that can be used in the method according to the invention may be anodically depositable EDL coating compositions (ADL) known per se. They contain anodically depositable binders, for example based on polyesters, epoxy resin esters, (meth)acrylic copolymer resins, maleinate oils or polybutadiene oils, for example having a weight-average molar mass (Mw) of from 300 to 10,000 and, for example, an acid number of from 35 to 300 mg KOH/g. The binders carry, for example, COOH, $SO_3H$ and/or $PO_3H_2$ groups. The resins may be converted into the aqueous phase after neutralisation of at least some of the acid groups.

EDL coating compositions used in the method according to the invention especially as an anti-corrosive primer coat are preferably cathodically depositable EDL coating compositions (CDL) known per se. They contain cathodically depositable binders, for example resins containing primary, secondary and/or tertiary amino groups, the amine numbers of which resins are, for example, from 20 to 250 mg KOH/g. The weight-average molar mass (Mw) of such CDL binders is preferably from 300 to 10,000. The resins can be converted into the aqueous phase after quaternisation or neutralisation of at least some of the basic groups. Examples of such CDL binders are aminoepoxy resins, amino(meth) acrylate resins, aminopolyurethane resins, polybutadiene resins containing amino groups, and/or modified epoxy resin-carbon dioxide-amine reaction products.

The EDL binders can be self-crosslinking or crosslink by external means; in the latter case, they carry groups capable of chemical crosslinking and the EDL coating compositions then contain crosslinking agents. The EDL binder systems are curable by means of heat, especially by stoving. Heat-curing may be curing of the EDL binder system by radical polymerisation of olefinically unsaturated double bonds and/or by condensation reactions and/or addition reactions. The EDL binder systems may be in the form of mixtures of EDL binder systems that are heat-curable by radical polymerisation of olefinically unsaturated double bonds, and EDL binder systems that are curable by condensation reactions and/or addition reactions, and/or the EDL binder system contains one or more EDL binders that are heat-curable both by radical polymerisation of olefinically unsaturated double bonds and by condensation reactions and/or addition reactions. Preference is given to EDL binder systems that are heat-curable by radical polymerisation of olefinically unsaturated double bonds or that are heat-curable by condensation reactions and/or addition reactions. Special preference is given to EDL binder systems that are heat curable by condensation reactions and/or addition reactions.

In the case of EDL binder systems that are heat-curable by radical polymerisation, the EDL binders contain radically polymerisable olefinically unsaturated double bonds according to a C=C equivalent weight of the resin solids of, for example, from 250 to 2000. The EDL binders that are heat-curable by radical polymerisation may be present, for example, in combination with non-ionic radically polymerisable prepolymers (as representatives of non-ionic additional resins) and/or radically polymerisable reactive diluents (radically polymerisable monomers).

Examples of non-ionic, radically polymerisable prepolymers or oligomers, which may be contained as non-ionic additional resins especially in EDL coating compositions that are heat-curable by radical polymerisation, are (meth) acryl-functional (meth)acrylic copolymers, epoxy resin (meth)acrylates, polyester (methacrylates, polyether (meth) acrylates, polyurethane (meth)acrylates, unsaturated polyesters, unsaturated polyurethanes or silicone (meth) acrylates having number-average molecular masses (Mn) preferably in the range from 200 to 10,000, particularly preferably from 500 to 3000, and having on average from 2 to 20, preferably from 3 to 10, radically polymerisable olefinic double bonds per molecule.

The radically polymerisable reactive diluents which may be contained in the EDL coating compositions in amounts of from 0 to 20 wt. %, based on the resin solids of the EDL binder system, are defined low molecular weight compounds which may be mono-, di- or poly-unsaturated. Examples of such reactive diluents are: (meth)acrylic acid esters, vinyl acetate, vinyl ethers, substituted vinylureas, ethylene and propylene glycol di(meth)acrylate, 1,3- and 1,4-butanediol di(meth)acrylate, vinyl (meth)acrylate, allyl (meth)acrylate, glycerol tri-, di- and mono(meth)acrylate, trimethylolpropane tri-, di- and mono-(meth)acrylate, styrene, vinyltoluene, divinylbenzene, pentaerythritol tri- and tetra-(meth)acrylate, di- and tri-propylene glycol di(meth) acrylate, hexanediol di(meth)acrylate.

In the case of EDL binder systems that are heat-curable by condensation and/or addition reactions, the EDL binders contain one or more functional groups that are amenable to thermally induced chemical crosslinking by condensation and/or addition reactions. If the EDL binders are self-crosslinking, they possess reactive groups that are complementary to one another as the base for a thermally induced covalent crosslinking. In the case of EDL binders that crosslink by external means, which are preferred, the choice of crosslinking agents present, which in itself is not critical, depends on the functionality of the EDL binders, that is to say the crosslinking agents are so chosen that they have a reactive functionality complementary to the functionality of the EDL binders, it being possible for the functional groups to react with one another thermally with addition and/or condensation. Examples of addition reactions suitable for the crosslinking of the EDL binder systems are the ring-opening addition of an epoxy group to a carboxyl-, hydroxyl- or hydrogen-active amino group, the ring-opening addition of a cyclic carbonate group to a hydrogen-active amino group, or the addition of a C═C double bond bonded directly to a carbonyl group, especially a (meth)acrylic double bond, to a hydroxyl- or hydrogen-active amino group. Examples of condensation reactions suitable for the crosslinking of the EDL binder systems are the reaction of a hydroxyl- or hydrogen-active amino group with a blocked isocyanate group with formation of a urethane or urea group and removal of the blocking agent, the reaction of a hydroxyl group with an N-methylol group with removal of water, the reaction of a hydroxyl group with an N-methylol ether group with removal of the etherifying alcohol, the transesterification reaction of a hydroxyl group with an ester group with removal of the esterifying alcohol, the transamidation reaction of a hydrogen-active amino group with an ester group with removal of the esterifying alcohol. It is also possible for a plurality of complementary functionalities to be present side by side in an EDL binder or EDL binder system that is heat-curable by addition and/or condensation reactions, provided such functionalities are compatible with one another, so that two or more different reactions of the type mentioned above by way of example may occur during stoving. The crosslinking agents optionally used in the EDL binder systems may be present individually or in a mixture. Some examples of crosslinking agents suitable for use in EDL binder systems that crosslink by external means are listed below:

1) Crosslinking agents that are used preferably in combination with EDL binders having carboxyl-, hydroxyl- or hydrogen-active amino groups and that have epoxy groups in the molecule: polyepoxides having epoxy groups bonded directly to an alicyclic or bridged alicyclic ring, polyglycidyl compounds, such as polyglycidyl ethers, for example aromatic epoxy resins based on bisphenol A, polyglycidyl esters, epoxy-functional novolaks, epoxy-functional copolymers, for example copolymers of glycidyl (meth)acrylate, epoxidised polybutadiene, or polyepoxy compounds formed by targeted synthesis, for example addition products of epoxy-functional alcohols, such as, for example, 3,4-epoxytetrahydrobenzyl alcohol, with polyisocyanates, for example polyisocyanates conventionally employed in lacquers, polyurethane prepolymers having free NCO groups, or (meth)acrylic copolymers.

2) Crosslinking agents that are used preferably in combination with EDL binders having hydrogen-active amino groups and that have cyclic carbonate groups in the molecule: compounds having 5- or 6-membered cyclic carbonate groups, preferably having 2-oxo-1,3-dioxolan-4'-yl groups, for example prepared by reaction of carbon dioxide with the oxirane rings of polyepoxide or polyglycidyl compounds listed above under 1) or synthesised in a targeted manner with the use of suitable monomer compounds containing a cyclic carbonate group, for example by addition of hydroxy-functional cyclocarbonates, such as, for example, 4-hydroxymethyl-2-oxo-1,3-dioxolan, to polyisocyanates, for example polyisocyanates conventionally employed in lacquers, polyurethane prepolymers having free NCO groups, or (meth)acrylic copolymers.

3) Crosslinking agents that are used preferably in combination with EDL binders having hydroxyl- and/or hydrogen-active amino groups and that have blocked isocyanate groups in the molecule: blocked polyisocyanates conventionally employed in lacquers. Examples thereof are any desired di- and/or polyisocyanates in which the isocyanate groups have been reacted with a blocking agent (a monofunctional compound containing active hydrogen). Examples of polyisocyanates are aromatic, araliphatic and (cyclo)aliphatic diisocyanates, such as, for example, hexamethylene diisocyanate, (methyl)cyclohexane diisocyanate, tetramethylxylylene diisocyanate, isophorone diisocyanate, biscyclohexylmethane diisocyanate, toluylene diisocyanate, diphenylmethane diisocyanate, as well as oligomers derived from diisocyanates. Examples of such oligomers are polyisocyanates formed by dimerisation or trimerisation, as well as reaction products of stoichiometrically excess diisocyanate with water, amines or polyols. Such polyisocyanates contain uretdione, isocyanurate, biuret, allophanate, urea and/or urethane groups. Examples of blocking agents are alcohols, such as n-butanol, isopropanol, 2-ethylhexanol, (meth)allyl alcohol, hydroxyalkyl (meth)acrylates, for example hydroxyethyl (meth)acrylate; phenols; oximes such as methyl ethyl ketoxime, acetone oxime; lactams such as epsilon-caprolactam; imidazole or pyrazole derivatives; CH-acidic compounds such as beta-diketones, for example acetylacetone, malonic acid dialkyl esters or acetic acid alkyl esters.

4) Crosslinking agents that are used preferably in combination with EDL binders having hydroxyl groups and that have methylol and/or methylol ether groups in the molecule: preferably aminoplastic resins conventionally employed in lacquers, especially triazine resins such as melamine resins or benzoguanamine resins.

5) Crosslinking agents that are used preferably in combination with EDL binders having hydroxyl- and/or hydrogen-active amino groups and that have in the molecule ester groups capable of transesterification or transamidation: polyesters having terminal end groups of the —COOalkyl type, especially beta-hydroxy ester end groups, tris(alkoxycarbonylamino)-1,3,5-triazines (TACT).

6) Crosslinking agents that are used preferably in combination with EDL binders having hydroxyl- and/or hydrogen-active amino groups and that have C═C double bonds bonded directly to carbonyl groups, especially (meth)acrylic double bonds. Examples are inter alia the non-ionic, radically polymerisable prepolymers or oligomers mentioned above, as well as adducts of polyisocyanates mentioned under 3) and hydroxyalkyl (meth)acrylates.

For the production of the EDL coating compositions used in the method according to the invention, the EDL binders may be used in the form of an aqueous EDL binder dispersion, which may optionally contain, for example, crosslinking agents. EDL binder dispersions can be prepared by synthesis of EDL binders in the presence or absence of organic solvents and conversion into an aqueous dispersion by dilution with water of the EDL binders neutralised with neutralising agents. The EDL binders can be converted into the aqueous dispersion in admixture with, for example, crosslinking agents. Organic solvent, where present, can be removed to the desired content, for example by distillation in vacuo, before or after conversion into the aqueous dispersion.

In addition to the EDL binders, water and any crosslinking agents, non-ionic additional resins, unsaturated prepolymers, reactive diluents and/or paste resins that may be present, the EDL coating compositions used in the method according to the invention may contain pigments, fillers, photoinitiators, heat-activatable radical initiators, solvents, and/or additives conventionally employed in lacquers.

Examples of pigments are the conventional inorganic and/or organic coloured pigments and/or effect pigments, such as, for example, titanium dioxide, iron oxide pigments, carbon black, phthalocyanine pigments, quinacridone pigments, metal pigments, for example of titanium, aluminium or copper, interference pigments, such as, for example, titanium-dioxide-coated aluminium, coated mica. Examples of fillers are kaolin, talcum or silicon dioxide. The nature and amount of the pigments is dependent on the intended use of the EDL coating compositions.

The pigments and/or fillers can be dispersed in a portion of the EDL binder and then milled in a suitable apparatus, for example a bead mill, following which completion is effected by mixing with the remaining portion of EDL binder. It is then possible to prepare the EDL coating composition or bath from that material—after the addition of neutralising agents, where not already added—by dilution with water (single-component method).

Pigmented EDL coating compositions or baths can, however, also be prepared by mixing an EDL binder dispersion and a pigment paste that has been prepared separately (two-component method). To that end, an EDL binder dispersion is further diluted, for example, with water, and an aqueous pigment paste is then added. Aqueous pigment pastes are prepared by methods known to the person skilled in the art, preferably by dispersion of the pigments and/or fillers in paste resins conventionally employed for such purposes.

The weight ratio of pigment plus filler/binder plus crosslinking agent in the EDL coating compositions used in the method according to the invention is, for example, from 0:1 to 0.8:1; for pigmented lacquers it is preferably from 0.05:1 to 0.4:1.

The EDL coating compositions used in the method according to the invention may contain volatile and/or non-volatile additives, for example in amounts of from 0.1 to 5 wt. %, based on the resin solids. Such additives are especially those which are known for EDL coating compositions, for example wetting agents, neutralising agents, flow agents, catalysts, corrosion inhibitors, antifoams, light stabilisers, antioxidants, colourings, biocides and conventional anti-pitting additives.

The EDL coating compositions used in the method according to the invention may contain photoinitiators, for example in amounts of from 0.1 to 5 wt. %, based on the resin solids. It is advantageous if their absorption is in the wavelength range from 260 to 450 nm. Examples of photoinitiators, which may be contained in the EDL coating compositions alone or in a mixture, are benzoin and its derivatives, acetophenone and its derivatives, for example 2,2-diacetoxyacetophenone, benzophenone and its derivatives, thioxanthone and its derivatives, anthraquinone, 1-benzoylcyclohexanol, organophosphorus compounds, such as, for example, acylphosphine oxides.

The EDL coating compositions used in the method according to the invention, especially the EDL coating compositions that are heat-curable by radical polymerisation, may contain heat-activatable radical initiators. Examples of thermolabile radical initiators are organic peroxides, organic azo compounds or C—C-cleaving initiators, such as dialkyl peroxides, peroxocarboxylic acids, peroxodicarbonates, peroxide esters, hydroperoxides, ketone peroxides, azodinitriles or benzpinacol silyl ether. The preferred amounts used are from 0.1 to 5 wt. %, based on the resin solids.

The additives, photoinitiators and thermolabile radical initiators can be introduced into the EDL coating compositions in any desired manner, for example during synthesis of the binders, during the preparation of EDL binder dispersions, via a pigment paste or, alternatively, separately.

The EDL coating compositions used in the method according to the invention may also contain conventional solvents in the amounts conventionally employed for EDL coating compositions. Examples are glycol ethers, such as butyl glycol and ethoxypropanol, and alcohols, such as butanol. The solvents can be introduced into the EDL coating compositions in various ways, for example as a constituent of binder or crosslinking agent solutions, via an EDL binder dispersion, as a constituent of a pigment paste or, alternatively, by separate addition. The solvent content of the EDL coating compositions is, for example, from 0 to 5 wt. %, based on coatable EDL bath.

The EDL coating compositions used in the method according to the invention can be prepared by the known methods for the preparation of EDL baths, that is to say in principle either by means of the above-described single-component method or by means of the two-component method.

In the context of the method according to the invention, the EDL coating compositions used in the method according to the invention can be applied in the conventional manner, by electro-deposition, in the context of a single-layer or multi-layer lacquering, to various substrates that have edges and that are electrically conductive or have been rendered electrically conductive, for example that have been provided with an electrically conductive coating layer, especially metallic substrates. As has been mentioned above, the edges can be accessible to an observer, or to the UV irradiation carried out in step 2), either completely or only in part.

The method according to the invention is suitable especially for the motor vehicle sector, for example for the application of anticorrosive EDL primer coats to motor vehicle bodies or parts of motor vehicle bodies. The EDL primer coats may optionally be provided with further lacquer layers. However, it is also possible in the method according to the invention to deposit the EDL coating compositions electrophoretically as, for example, a finishing lacquer, a clear lacquer, or as a lacquer layer that is arranged within a multilayer lacquer coating and may have a decorative function.

In addition to the above-mentioned content in the EDL binder systems of olefinically unsaturated double bonds that are radically polymerisable under UV irradiation, it is essential to the invention that the coating layers deposited electrophoretically in the conventional manner from the EDL coating compositions on substrates having edges be subjected to UV irradiation before the stoving operation effecting curing of the EDL coating layers. Depending on the embodiment of the method according to the invention, the entire surface of the uncured EDL coating layer or a portion thereof, for example only one or more edges of the substrate provided with the uncured EDL coating layer, is irradiated with UV. The UV irradiation of the uncured EDL coating layer carried out in step 2) of the method according to the invention leads to radical polymerisation of olefinically unsaturated double bonds in the EDL binder system in the uncured EDL coating layer, but does not lead to curing of the EDL coating layer. Curing of the EDL coating layer is effected only in step 3) of the method according to the invention by stoving. For example, after the UV irradiation the EDL coating layer does not achieve the pendulum hardness that will be reached after the subsequent heat-curing by stoving and/or can, for example, still be removed by wiping several times with a cotton wool swab soaked with solvent. After stoving, the EDL coating layer is resistant to solvents and cannot be removed even by wiping more tan 100 times with a cotton wool swab soaked with solvent. Incomplete curing of the EDL coating layer during step 2) of the method according to the invention can be ensured, for example, by suitable selection of the composition of the EDL coating composition and/or the manner in which the method is carried out in step 2). For example, the pigmenting, the nature and amount of the photoinitiators and the EDL binder system in the EDL coating composition can be so chosen that curing of the EDL coating layer deposited from the EDL coating composition is impossible or is possible only with difficulty in step 2) of the method according to the invention. For example, a pigmenting that more or less absorbs UV radiation can be chosen, and/or no or only a small amount of photoinitiator is used, and/or the EDL binder system is curable only with difficulty or is not curable by radical polymerisation. The parameters of step 2) can also be influenced in an appropriate manner, as will be discussed further below.

Following the EDL coating of step 1), the EDL coating layer is exposed to UV radiation. Suitable UV sources are, for example, those having emissions in the wavelength range from 180 to 420 nm, preferably from 200 to 400 nm. Examples of UV sources are optionally doped high-pressure, medium-pressure and low-pressure mercury emitters, discharge tubes, such as, for example, low-pressure xenon lamps, UV point emitters, black-light tubes, high-energy electronic flash devices, such as, for example, UV flash lamps.

The UV sources may be designed to operate continuously or discontinuously. A possibility for UV sources that can be switched on and off for a short time (timed) consists in the upstream provision of, for example, movable diaphragms, or UV flash lamps are used.

The arrangement of the UV sources is known in principle; it can be adapted to the conditions of the substrate, for example of a motor vehicle body, or the edges of the substrate that are to be irradiated. For example, the substrate can be irradiated as a whole, for example as it passes through a UV irradiation tunnel, or it is possible to use a radiation curtain, which moves relative to the substrate. In addition, a point-like UV source or an emitter of small area can be guided over the substrate by means of an automatic device. In a corresponding manner it is possible to expose to UV radiation only the edges of the substrate or regions of the substrate having edges.

The distance of the UV source can be fixed, or it is adapted to the substrate at a desired value, for example to the shape of the substrate or the arrangement of the edges of the substrate. The distances of the UV sources are, for example, in the range from 2 to 50 cm relative to the surface of the EDL coating layer.

The irradiation time is, for example, in the range of the duration of a UV flash of, for example, from 100 milliseconds to 5 minutes, depending on the irradiation method used and the nature and number of the UV sources. Preference is given to an irradiation time, that is to say the time during which the UV radiation actually acts upon the uncured EDL coating layer, of less than 5 minutes.

The energy supplied to the uncured EDL coating layer by UV irradiation during step 2) of the method according to the invention is not sufficient to cure it. If the composition of the EDL coating composition used in the method according to the invention is such that the EDL coating layer is completely curable by UV irradiation in the course of the radical polymerisation, then the UV irradiation is so carried out that complete curing of the EDL coating layer is definitely avoided. The measures suitable therefor are known to the person skilled in the art; for example, the duration of action of the UV radiation, the distance of the UV source from the EDL coating layer, the wavelength and/or output of the UV source can be chosen accordingly.

The UV irradiation of step 2) is carried out before the stoving of step 3). The UV irradiation and the stoving can be separate from one another in terms of space and time. For example, the UV sources may be located outside the stoving oven. In the case of goods produced in series, it is also possible for the UV sources to be located at the beginning of the stoving oven or in the front region thereof, for example in the front third of the stoving oven. For example, the UV sources may be arranged in the inlet region of the stoving oven. The method according to the invention is then distinguished by the fact that the UV irradiation and the stoving are partly carried out in parallel in terms of space and time, but the UV irradiation of step 2) is already complete while the curing of step 3) has not or has only just begun, for example while the substrate is still being heated.

After the UV irradiation, the still uncured EDL coating layer, which has been subjected to UV radiation over its entire surface or over a portion thereof, is cured in step 3) by stoving. Depending on the nature of the EDL binder system, stoving is carried out, for example, for a duration of from 20 to 30 minutes at oven temperatures of from 80 to 220° C.

The method according to the invention permits the production of cured EDL coatings with good edge coverage on electrically conductive substrates having edges. The corrosion protection of EDL-primed edges, especially of metal substrates, which have been exposed to UV radiation before curing, is improved. The undesired occurrence of visually disturbing edge corrosion phenomena during subsequent use of the lacquered substrates can be avoided.

EXAMPLE 1

Preparation of a CDL Binder Solution

According to EP-B-12 463, 301 g of diethanolamine, 189 g of 3-(N,N-dimethylamino)-propylamine and 1147 g of an adduct of 2 mol. of 1,6-hexanediamine and 4 mol. of the glycidyl ester of versatic acid (Cardura® E 10 from Shell) are added to 5273 g of bisphenol A epoxy resin (epoxy equivalent weight 475) in 3000 g of ethoxypropanol. The reaction mixture is maintained at from 85 to 90° C. for 4 hours, with stirring, and then at 120° C. for one hour. It is then diluted with ethoxypropanol to 66% solids.

EXAMPLE 2

Preparation of a CDL Binder Solution 3120 g of binder solution are prepared according to DE-B-27 32 902, column 9, Example A2, from 706 g of bisphenol A epoxy resin (epoxy equivalent weight 260), 631 g of ethyl glycol acetate, 0.25 g of hydroquinone, 765 g of semi-ester of tetrahydrophthalic anhydride and hydroxyethyl methacrylate, and 1017 g of a 70% solution of a monoisocyanate of toluylene diisocyanate and dimethylethanolamine in ethyl glycol acetate, and the solution is mixed with 1930 g of a binder solution from Example 1 diluted to 60% solids with ethoxypropanol. The solids content of the solution is 66%. The calculated double bond equivalent weight is 618, based on solid resin.

EXAMPLE 3

Preparation of a Crosslinking Agent Solution 875 g of the solution of an adduct of 2,4-toluylene diisocyanate and trimethylolpropane (molar ratio 3:1), 75% in ethyl acetate, is diluted to a solids content of 50% with xylene, and 0.25 g of hydroquinone is added thereto. After addition of 348 g of hydroxyethyl acrylate, the reaction mixture is heated for approximately 8 hours, with reflux cooling, until the NCO value has fallen virtually to zero. Ethyl acetate is then removed by fractional distillation at temperatures below 100° C., optionally with the application of a vacuum, until a solids content of 75% has been achieved. The mixture is then adjusted to a solids content of 70% with methyl isobutyl ketone. The calculated double bond equivalent weight is 335, based on solid resin.

EXAMPLE 4

Preparation of a Crosslinking Agent Solution

Example 3 is repeated, with the difference that 360 g of butyl glycol are used instead of 348 g of hydroxyethyl acrylate.

EXAMPLE 5

Preparation of a CDL Bath 505 g of the binder solution from Example 2 are mixed, with thorough stirring, with 50 g of ethoxypropanol, 2.4 g of carbon black and 235 g of titanium dioxide, and the mixture is milled in a bead mill. The batch is completed with 273 g of the binder solution from Example 2, 161 g of the crosslinking agent solution from Example 3, 50 g of phenoxypropanol and 31 g of 50% aqueous formic acid. Dibutyltin dilaurate is mixed in homogeneously corresponding to an amount of 0.5% tin, based on the resin solids. A CDL bath is prepared using 4067 g of deionised water.

EXAMPLE 6

Preparation of a CDL Bath

The procedure of Example 5 is followed, with the difference that 161 g of the crosslinking agent solution from Example 4 are used instead of 161 g of the crosslinking agent solution from Example 3.

EXAMPLE 7

Preparation of a CDL Bath 505 g of the binder solution from Example 1 are mixed, with thorough stirring, with 20 g of ethoxypropanol, 2.4 g of carbon black and 235 g of titanium dioxide, and the mixture is milled in a bead mill. The batch is completed with 273 g of the binder solution from Example 1, 132 g of the crosslinking agent solution from Example 3, 50 g of phenoxypropanol and 31 g of 50% aqueous formic acid. Dibutyltin dilaurate is mixed in homogeneously corresponding to an amount of 0.5% tin, based on the resin solids. A CDL bath is prepared using 4067 g of deionised water.

EXAMPLE 8

Preparation of a CDL Bath

Example 7 is repeated, with the difference that 132 g of the crosslinking agent solution from Example 4 are used instead of 132 g of the crosslinking agent solution from Example 3.

The CDL baths from Examples 5 to 8 are stirred, uncovered, for three days, without the admission of light. Lacquer films are then deposited cathodically from each of the CDL baths on perforated (hole diameter 10 mm), degreased, non-phosphated motor vehicle body sheets in a dry layer thickness of 20 $\mu$m, and the sheets are rinsed with deionised water. After an evaporation time of 30 minutes at room temperature, the test sheets are exposed to UV radiation and then stoved for 17 minutes at an object temperature of 175° C. or are stoved under the same conditions without being exposed to UV radiation. The stoved test sheets are exposed to a salt spray according to DIN 50 021-SS for 120 hours. After the exposure, the edges of the holes are evaluated for edge rust (characteristic values CV 0 to 5; CV 0, edges without rust; CV 1, occasional rust spots at edges; CV 2, rust spots at less than ⅓ of the edges; CV 3, ⅓ to ½ of the edges covered with rust; CV 4, more than ½ of the edges covered with rust; CV 5, edges completely rust). The results are to be found in the following Table:

| CDL.bath | without UV | with UV[1)] | with UV[2)] |
|---|---|---|---|
| 5 | CV 5 | CV 1 acc. inv. | CV 0 acc. inv. |
| 6 | CV 5 | CV 2-3 acc. inv. | CV 2 acc. inv. |
| 7 | CV 5 | CV 2 acc. inv. | CV 1-2 acc. inv. |
| 8 | CV 5 | CV 5 | CV 5 |

[1)]UV irradiation in a type U 300 - M- 2 TR IST belt device, medium-pressure mercury radiator, 100 W/cm, belt speed 2 m/min, object distance 10 cm

[2)]As [1)], but belt speed 1 m/min, object distance 10 cm acc. inv. = method according to the invention

What is claimed is:

1. A method of electro-dipcoating comprising the steps of:

1) electro-deposition of a coating layer from an electrically depositable coating composition containing a heat-curable binder system containing olefinically unsaturated double bonds that are radically polymerizable under UV irradiation, on an electrically conductive substrate having edges, 2) UV irradiation of at least part of the electrically deposited coating layer to radically polymerize the olefinically unsaturated double bonds, while avoiding complete curing of the electrically deposited coating layer, 3) complete curing of the electrically deposited coating layer by stoving.

2. The method according to claim 1, wherein the electrically depositable coating compositions are selected from the group consisting of anodic depositable electro-dipcoating lacquers and cathodic electro-dipcoating lacquers.

3. The method according to claim 2, wherein the electro-dipping lacquers and aqueous coating compositions comprising about 10% to about 30% solids.

4. The method according to claim 1, wherein the substrate is a three dimensional, electrically conductive substrate having edges and having regions that are accessible and having regions that are not accessible to an observer.

5. The method according to claim 4, wherein the three dimensional substrate is at least a part of a motor vehicle body.

6. The method according claim 1, wherein the heat-curable binder system that contains radically polymerizable olefinically unsaturated double bonds is selected from the group consisting of vinylic C=C double bonds, (meth) allylic C=C double bonds, and C=C double bonds bonded directly to carbonyl groups.

7. The method according to claim 6, wherein the heat-curable binder system contains radically polymerizable olefinically unsaturated double bonds according to a C=C equivalent weight of the resin solids of from 250 to 10,000.

8. The method according to claim 7, wherein the heat-curable binder system contains radically polymerizable olefinically unsaturated double bonds that are a constituent of the binders and/or of the crosslinking agents.

9. The method according to claim 1, wherein the heat-curable binder system further comprises at least one electro-dipcoating binder, crosslinking agents, paste resins, non-ionic resins, and combinations thereof.

10. The method according to claim 9, wherein the non-ionic additional resins that are heat curable by radical polymerization are selected from the group consisting of (meth)acryl-functional (meth)acrylic copolymers, epoxy resin (meth)acrylates, polyester (meth)acrylates, polyether (meth)acrylates, polyurethane (meth)acrylates, unsaturated polyesters, unsaturated polyurethanes, and silicone (meth) acrylates having a number average molecular mass in the range of about 200 to about 10,000 radically polymerisable olefinic double bonds per molecule.

11. The method according to claim 1, wherein the heat-curable binder system are curable by condensation reactions.

12. The method according to claim 1, wherein the heat-curable binder systems are curable by addition reaction.

13. The method according to claim 1, wherein the electro-dipcoating compositions further comprise at least one pigment, filler, photoinitiator, heat-activatable radical initiator, solvent, and combinations thereof.

14. The method according to claim 13, wherein the pigment is selected from the group consisting of organic colored pigment, inorganic colored pigment, effect pigment and combinations thereof.

15. The method according to claim 13, wherein the filler is selected from the group consisting of kaolin, talcum, and silicon dioxide.

16. The method according to claim 13, wherein the photoinitiator is selected from the group consisting of benzion, benzoine derivatives, acetophenone, acetophenone derivatives, benzophone, benzophone derivatives, thioxanthone, thioxanthone derivatives, anthraquinone, 1-benzoylcyclohexanol, organophosphorus compounds and combinations thereof.

17. The method according to claim 13, wherein the heat-activatable radical initiators selected from the group consisting of organic peroxides, organic azo compounds, and C—C cleaving initiators.

18. The method according to claim 13, wherein the solvent is selected from the group consisting of glycol ethers and alcohols.

19. The method according to claim 1, wherein the UV irradiation of the electrically deposited coating layer of step 2) is carried out in the region of the edges.

20. The method according to claim 1, wherein the UV irradiation of the electrically deposited coating layer of step 2) is carried out in the regions of the substrate surface visible to an observer.

21. The method according to claim 1, wherein the UV irradiation of the electrically deposited coating layer of step 2) is carried out in the regions of the electro-dipcoated edges of the substrate are directly accessible to an observer.

22. The method according to claim 1, wherein the UV irradiation of the electrically deposited coating layer occurs at a wavelength in the range of about 180 nm to about 420 nm.

23. The method according to claim 1, wherein the UV irradiation of the electrically deposited coating layer operates continuously.

24. The method according to claim 1, wherein the UV irradiation of the electrically deposited coating layer operates discontinuously.

25. A substrate obtained by electro-dipcoating according to claim 1.

* * * * *

UNITED STATES PATENT AND TRADEMARK OFFICE

CERTIFICATE OF CORRECTION

PATENT NO. : 6,736,950 B1
APPLICATION NO. : 10/018391
DATED : May 18, 2004
INVENTOR(S) : Klausjörg Klein, Walter Kühhiri and Siegfried Kuphal It is certified that error appears in the above-identified patent and that said Letters Patent is hereby corrected as shown below:

Col. 14 Claim 3, Line 2: “and” to be replaced with --are--

Col. 15 Claim 10, Line 9: --and having on average from 2 to 20-- to be inserted between “10,000” and “radically”

Col. 16 Claim 16, Line 4: “benzophone, benzophone ” to be replaced with --benzophenone, benzophenone--

Col. 16 Claim 17, Line 2: “radical initiators” to be replaced with --radical initiator is--

Col. 16 Claim 21, Line 4: --that-- to be inserted between “substrate” and “are directly”

Signed and Sealed this

Twenty-second Day of May, 2007

JON W. DUDAS
*Director of the United States Patent and Trademark Office*